US005356093A

United States Patent [19]

Kewin

[11] Patent Number: 5,356,093

[45] Date of Patent: Oct. 18, 1994

[54] TUBULAR CORE ASSEMBLIES FOR ROLLS OF PAPER OR OTHER SHEET MATERIAL

[76] Inventor: Daniel D. Kewin, 16 Dogwood Drive, Brantford, Ontario, Canada, N3R 1R3

[21] Appl. No.: 825,887

[22] Filed: Jan. 27, 1992

[51] Int. Cl.[5] ..... B65H 75/18

[52] U.S. Cl. ..... 242/610.4; 242/613.5

[58] Field of Search ..... 242/68.6, 68.5, 68, 242/68.4, 118.31

[56] References Cited

U.S. PATENT DOCUMENTS

| | | | |
|---|---|---|---|
| 659,306 | 10/1900 | Kingsland | 242/68.6 |
| 1,008,924 | 11/1911 | Orr | 242/68.6 |
| 2,076,870 | 4/1937 | Taylor | 242/68.6 |
| 2,767,895 | 10/1956 | Smith | 224/275 |
| 3,162,305 | 12/1964 | Schoppa | 224/42.46 R X |
| 3,291,413 | 12/1966 | Cushing et al. | 242/68.6 |
| 3,608,712 | 9/1971 | Savoie | 206/554 X |
| 3,800,503 | 4/1974 | Maki | 220/407 X |
| 4,154,383 | 5/1979 | Honatzis | 224/42.46 R |
| 4,679,701 | 7/1987 | Ackermann et al. | 220/404 |
| 4,850,508 | 7/1989 | Lee | 206/554 X |
| 4,874,139 | 10/1989 | Kewin | 242/68.6 |
| 4,993,845 | 2/1991 | Faltynek | 383/111 X |
| 5,022,528 | 6/1991 | Savoy | 150/117 X |

FOREIGN PATENT DOCUMENTS

| | | | |
|---|---|---|---|
| 640479 | 5/1962 | Canada | 242/68.6 |

*Primary Examiner*—John M. Jillions
*Attorney, Agent, or Firm*—Rogers & Scott

[57] ABSTRACT

A tubular core assembly for a roll of paper or other sheet material has a hollow cylindrical core member formed by multiple wraps of paperboard material. An annular collar is located within each opposite end portion of the core member, each collar being a rigid body of non-isotropic material and having an outer annular surface secured to the inner annular surface of the core member and an inner annular surface shaped to receive a roll supporting chuck. The ratio of collar wall thickness to core member wall thickness is in the range of from about 1.3:1 to about 2:1.

4 Claims, 1 Drawing Sheet

TUBULAR CORE ASSEMBLIES FOR ROLLS OF PAPER OR OTHER SHEET MATERIAL

Figures 1, 2:
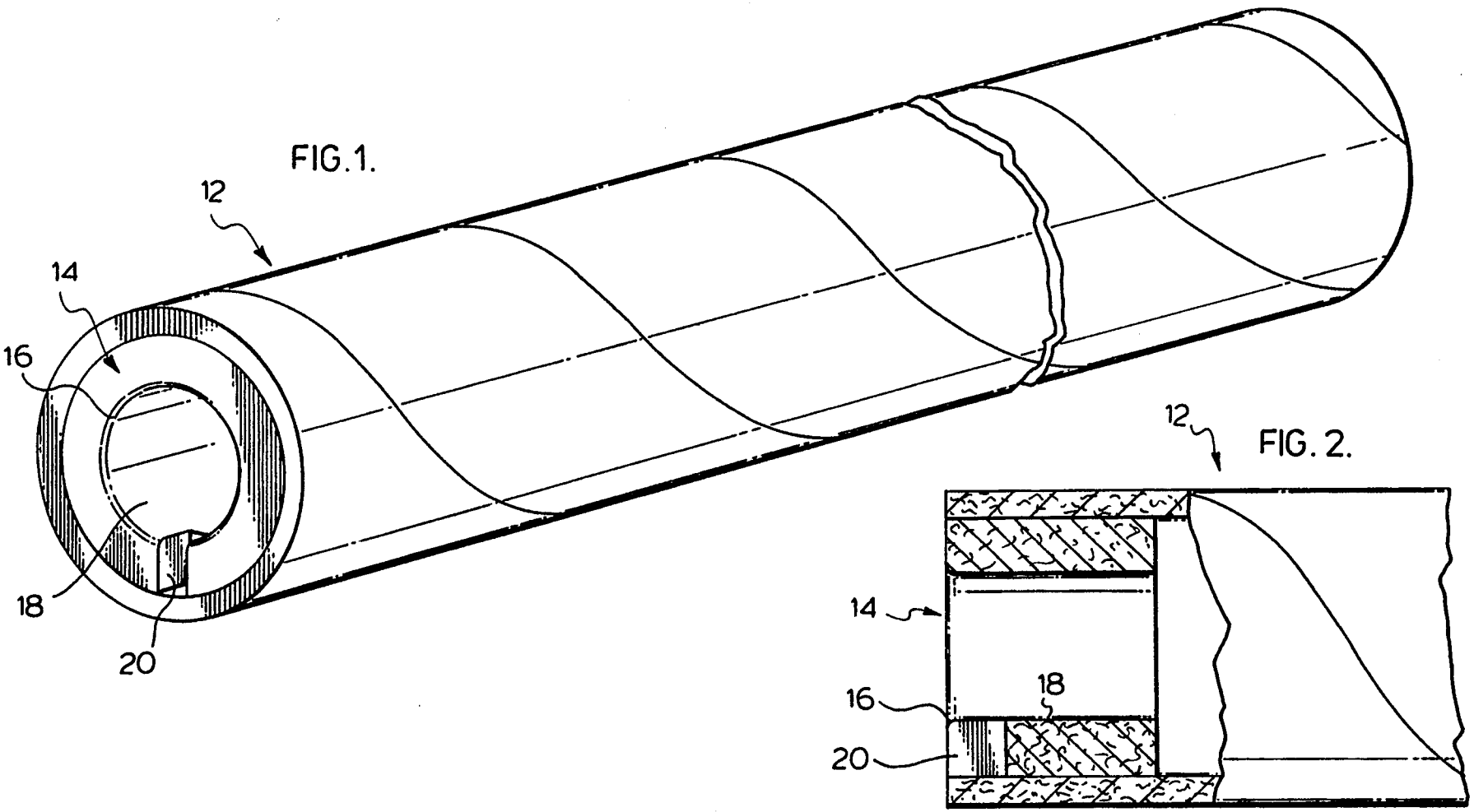

This invention relates to tubular core assemblies for rolls of paper or other sheet material.

U.S. Pat. No. 4,874,139 issued Oct. 17, 1989 describes and claims a tubular core assembly for a roll of paper or other sheet material and also describes some of the problems associated with such tubular core assemblies. According to this U.S. patent, an annular collar is provided within each opposite end portion of a hollow cylindrical core member, and a pair of plugs insertable into the collars at opposite ends of the tubular core member are also provided. The contents of this U.S. patent are hereby incorporated herein by reference.

In the specific embodiment described in this U.S. patent, the core member is 4.5 feet long and has an external diameter of 4 inches and an internal diameter of 3.5 inches, i.e. has a wall thickness of 0.25 inches. This is in contrast to a conventional core member which has an external diameter of 4 inches and an internal diameter of 3 inches, i.e. with a wall thickness of 0.5 inches. The outer diameter of each collar in the specific embodiment described in the U.S. patent is 3.5 inches and the internal diameter is 3 inches, i.e. the same as the internal diameter of a conventional core member. The thickness of each collar is therefore also 0.25 inches. The length of each collar is about 1.5 inches.

The present invention modifies and improves the hollow cylindrical core member and collars described in U.S. Pat. No. 4,874,139 so as to provide an improved tubular core assembly which copes in an even more satisfactory manner with the problems described in the U.S. patent, and also copes with other problems associated with present day use of rolls of paper or other sheet material.

One of these problems is the cyclical pounding which occurs between the collars and the chucks when a heavy large diameter roll of paper is rotated at high speed. This occurs because in practice a heavy large diameter roll of paper is usually not truly balanced in the rotational sense, and rotation at high speed results in out of balance rotation and consequent cyclical pounding of the collars on the chucks. This becomes in effect a hammer and anvil action between the collars and the chucks. For example, a roll weighing about 1 ton and over 40 inches in diameter and rotating at a speed of about 160 revolutions per minute may, if the paper if not truly balanced, cause very severe hammer and anvil type forces to occur between the collars and the chucks. It is therefore important that the collars be strong enough to resist the tendency for the inner surface of the collars to become eccentric, since this would make the problem worse. It is thus especially important that the shape of the ends of the tubular core assembly be preserved.

In addition to the problems associated with the rotation of heavy, i.e. substantially full rolls of paper, at relatively high speeds as described above, there are also problems associated with rotation when a roll is nearing expiry. Since the paper or other sheet material is unwound from a roll at a constant rate in terms of feet per minute, the speed of rotation of a roll near expiry will, because of its smaller diameter compared to that of a substantially full roll, be much faster in terms of revolutions per minute than a substantially full roll in order to maintain constant feet per minute speed of the paper or other sheet material.

Such faster revolution speed and lighter weight of a roll nearing expiry may result in bouncing or fluttering of the tubular core assembly relative to the chucks if a loose fit has resulted from the hammer and anvil effect of cyclical pounding while the roll was substantially full. This causes reduced press speeds due to web flutter which results in missed printing register and web breaks for lost time and excessive scrapped paper. It can cause the core member to disintegrate, i.e. explode, with possible resultant injury to personnel in the area. As indicated above therefore, it is extremely important that the integrity of the shape of the ends of the tubular core assembly be preserved.

The present invention is based on the realization that such problems can be substantially overcome by providing a tubular core assembly with a relatively large external diameter and a collar with relatively large wall thickness compared to the wall thickness of the core member.

According to the present invention therefore, a tubular core assembly for a roll of paper or other sheet material comprises a hollow cylindrical core member formed by multiple wraps of paperboard material and an annular collar within each opposite end portion of the core member, each collar being a rigid body of non-isotropic material and having an outer annular surface secured to the inner annular surface of the core member and an inner annular surface shaped to receive a roll supporting chuck, the ratio of collar wall thickness to core member wall thickness being in the range of from about 1.3:1 to about 2:1. The term paperboard material is intended to include paper.

Each collar may have a length in the range of from about 2 to about 10 inches. Each collar may have an internal diameter of about 3 inches and an outer diameter in the range of from about 3.5 to about 6 inches, and the core member may have an outer diameter in the range of from about 4 inches to about 7 inches. The core member may have a length in the range of from about 5 to about 10 feet.

Embodiments of the invention will now be described, by way of example, with reference to the accompanying drawings, of which:

FIG. 1 is an exploded perspective side view of one end portion of a tubular core assembly showing the core member and collar separately, and FIG. 2 is a sectional side view of the end portion of the tubular core assembly of FIG. 1 with the collar secured in the end portion of the core member.

Referring to the drawing, a tubular core assembly for a paper roll comprises a hollow cylindrical core member 12 and an annular collar 14 secured within each opposite end portion of the core member 12. The core member 12 is formed from strips (i.e. plies) of spirally wound Kraft paperboard, which is about 90% wood fibre with a thickness of 0.012 inches, these strips having a width of about 10 inches and being wound at a winding angle of about 20°. The core member 12 may be constructed in accordance with the teaching in U.S. Pat. No. 3,194,275 (Biggs Jr. et al) issued Jul. 13, 1965, the contents of which are hereby incorporated herein by reference. The teaching of Biggs Jr. et al is a spirally wound paper tube intended to be used as a core or carrier for heavy sheet material such as carpet material or the like, such tubes normally having a length of the order of 12 feet. In contrast, the core member 12 of the present invention will normally have a length of about 5 to 10 feet. A conventional core member for paper rolls is usually formed from plies with a thickness of about 0.035 inches and a width of 4 to 5 inches and a spiral winding angle of about 65°.

The Kraft paperboard referred to above as used in the preferred embodiment of the present invention has relatively long fibres which, when incorporated in a core member 12 formed in the manner described above, become substantially parallel to the length of the core member 12 and assist in maintaining dimensional stability.

Each collar 14 is formed of non-isotropic material such as moldwood, and has an outer annular surface which is a sliding fit in an end portion of the core member 12. Each collar 14 is secured in place by a suitable glue so that torque can be properly transmitted from the collars 14 to the core member 12. The front end of each collar 14 is sharply flared at 16 to facilitate entry of a stub-shaft chuck. The front end of each collar has a notch 20 shaped to receive a projection found on certain types of conventional stub-shaft chucks to enable torque to be properly transmitted from the chucks to the collars 14.

The inner surface 18 of each collar 14 has a configuration complementary to the outer annular surface of the chuck so that the chuck is receivable therein with a close fit. The collars 14 can also satisfactorily receive chucks of the type which have projections which are movable radially outwardly by appropriate mechanism to tightly engage the internal annular surface of a collar 14 into which the chuck is inserted.

The core member 12 will usually have a length of from about 5 to about 10 feet. At the present time, most conventional chucks have a diameter of 3 inches and therefore the internal diameter of the collars 14 will be 3 inches. The outer diameter of the core member may be from about 4 to about 7 inches. The notch 20 may have a length of about 1 inch and a width of about 0.75 inches.

In accordance with the invention, the ratio of collar wall thickness to core member wall thickness is at least about 1.3:1.

Depending on the outside diameter of the core member 12, the collars 14 may have an outer diameter ranging from about 3.5 to about 6 inches, the wall thickness of the collars 14 may range from about 0.3 to about 1 inch and the wall thickness of the core member 12 may range from about 0.2 inches to about 0.5 inches. The length of the collars 14 is preferably at least about 2 inches, for example about 4 inches.

Specific examples of tubular core assemblies in accordance with the invention will now be described.

EXAMPLE 1

The core member has a length of 9 feet, an outer diameter of 6 inches and an internal diameter of 5 inches, the wall thickness therefore being 0.5 inches.

Each collar has a length of 10 inches, an outer diameter of 5 inches and an inner diameter of 3 inches, the wall thickness therefore being 1 inch. The ratio of collar wall thickness to core member wall thickness is 2:1.

EXAMPLE 2

The core member has a length of 6 feet, an outer diameter of 4.4 inches and an internal diameter of 3.8 inches, with the wall thickness being 0.3 inches. Each collar has a length of 4 inches and outer diameter of 3.8 inches and an inner diameter of 3 inches, the wall thickness being 0.4 inches. The ratio of collar wall thickness to core member wall thickness is 1.3:1.

EXAMPLE 3

The core member has a length of 5 feet, an outer diameter of 4 inches and an inner diameter of 3.6 inches, the wall thickness being 0.2 inches. Each collar has a length of 4 inches, an outer diameter of 3.6 inches and an inner diameter of 3 inches, the wall thickness being 0.3 inches. The ratio of collar wall thickness to core member wall thickness is 1.5:1.

Such tubular core assemblies in accordance with the invention enable the problems described in the opening paragraphs of the specification to be substantially overcome. Further, after use, the collars 14 can be pried out of the core member 12 to enable the core member to be easily crushed and repulped. The collars 14 can also be separately easily crushed and repulped.

Though the invention is especially useful in connection with tubular core assemblies for paper rolls, tubular core assemblies is accordance with the present invention can also be used with other sheet material, including fabric material and thick heavy sheet material such as carpet material.

Other embodiments of the invention will be apparent to a person skilled in the art, the scope of the invention being defined in the appended claims.

I claim:

1. A tubular core assembly for a roll of paper or other sheet material comprising;

a hollow cylindrical core member formed by multiple wraps of paperboard material, and an annular collar within each opposite end portion of the core member, each collar being a rigid body of non-isotropic material and having an outer annular surface glued to the inner annular surface of the core member so that torque is properly transmitted from the collar to the core member, each collar also having an inner annular surface shaped to receive a roll supporting chuck, the ratio of collar wall thickness to core member wall thickness being in the range of from about 1.3:1 to about 2:1.

2. A tubular core assembly according to claim 1 wherein each collar has a length in the range of from about 2 to about 10 inches.

3. A tubular core assembly according to claim 1 wherein each collar has an internal diameter of about 3 inches, and an outer diameter in the range of from about 3.5 to about 6 inches, and the core member has an outer diameter in the range of from about 4 to about 7 inches.

4. A tubular core assembly according to claim 3 wherein each collar has a length in the range of from about 2 to about 10 inches, and the core member has a length in the range of from about 5 to about 10 feet.

* * * * *